US008578635B2

(12) United States Patent
Hill

(10) Patent No.: US 8,578,635 B2
(45) Date of Patent: Nov. 12, 2013

(54) QUICK-ATTACH ASSEMBLY FOR ATTACHING AN IMPLEMENT TO AN OFF-ROAD VEHICLE

(76) Inventor: Curt J. Hill, Warba, MN (US)

( * ) Notice: Subject to any disclaimer, the term of this patent is extended or adjusted under 35 U.S.C. 154(b) by 0 days.

(21) Appl. No.: 13/441,990

(22) Filed: Apr. 9, 2012

(65) Prior Publication Data

US 2013/0264079 A1 Oct. 10, 2013

(51) Int. Cl.
*E01H 5/04* (2006.01)

(52) U.S. Cl.
USPC ..... 37/231; 172/817

(58) Field of Classification Search
USPC ..... 172/272, 273, 810, 811, 817; 37/231
See application file for complete search history.

(56) References Cited

U.S. PATENT DOCUMENTS

| | | | | | |
|---|---|---|---|---|---|
| 4,248,451 | A * | 2/1981 | Usinger | 280/490.1 |
| 4,280,713 | A * | 7/1981 | Bruhn | 280/416.1 |
| 4,369,590 | A * | 1/1983 | Miller | 37/231 |
| 4,403,432 | A * | 9/1983 | Biance | 37/235 |
| 4,471,973 | A | 9/1984 | Beckmann, Sr. | |
| 4,680,880 | A * | 7/1987 | Boneta | 37/236 |
| 4,778,195 | A * | 10/1988 | Vachon | 280/477 |
| 6,079,728 | A | 6/2000 | Miller | |
| 6,129,371 | A * | 10/2000 | Powell | 280/461.1 |
| 6,202,328 | B1 * | 3/2001 | Fulton | 37/231 |
| 6,843,002 | B1 | 1/2005 | Moffitt | |
| 6,957,505 | B1 | 10/2005 | Moffitt | |
| 6,964,121 | B2 * | 11/2005 | Harris | 37/231 |
| 7,425,013 | B1 | 9/2008 | Bartlett | |
| 7,661,210 | B2 * | 2/2010 | Shepherd | 37/232 |
| 7,703,222 | B2 * | 4/2010 | Schmeichel | 37/232 |
| 7,849,614 | B2 | 12/2010 | Belzile et al. | |
| 7,997,015 | B2 * | 8/2011 | Belzile et al. | 37/231 |
| 8,291,622 | B2 * | 10/2012 | Gappy | 37/231 |
| 2004/0148811 | A1 * | 8/2004 | Harris | 37/231 |
| 2011/0047835 | A1 | 3/2011 | Belzile et al. | |
| 2011/0173847 | A1 * | 7/2011 | Ropog | 37/231 |
| 2012/0117833 | A1 * | 5/2012 | Hill | 37/231 |

* cited by examiner

*Primary Examiner* — Matthew D Troutman
(74) *Attorney, Agent, or Firm* — Dennis L. Thomte; Thomte Patent Law Office LLC

(57) ABSTRACT

A quick-attach mechanism for attaching an implement to the forward end of a push type assembly which is secured to an off-road vehicle. The quick-attach mechanism includes a front female quick-attach structure on the forward end of the push tube assembly and a rear male quick-attach structure attached to the implement. The front and rear quick-attach assemblies may be quickly selectively coupled together.

10 Claims, 8 Drawing Sheets

QUICK-ATTACH ASSEMBLY FOR ATTACHING AN IMPLEMENT TO AN OFF-ROAD VEHICLE

BACKGROUND OF THE INVENTION

1. Field of the Invention

This invention relates to a quick-attach assembly for attaching an implement such as a plow blade, sweeper, rake, brush, etc. to an off-road vehicle such as an ATV, UTV, riding mower or garden tractor.

2. Description of the Related Art

In recent years, it has become common to mount a plow blade or other implement on the forward end of an off-road vehicle such as an ATV, UTV, riding mower or garden tractor. Most manufacturers utilize a push tube assembly to mount the plow blade or implement to the vehicle. In most prior art plow blades or implements, the rearward end of the push tube assembly is pivoted to the vehicle about a transverse horizontal axis to permit the forward end of the push tube assembly, and the plow blade or implement secured thereto, to be raised and lowered.

In many prior art push tube assemblies, the rearward and forward ends of the push tubes thereof dwell in generally the same plane. In some cases, as in the plow blade of Bombardier, the forward ends of the push tubes dwell in a plane above the rearward ends thereof to enable the forward end of the push tube assembly to be secured to the upper rearward end of the plow blade.

Although the plow blades of the prior art perform satisfactorily, to the best of Applicant's knowledge, other than that disclosed in Applicant's co-pending applications, Ser. No. 13/135,042 filed Jun. 23, 2011 and Ser. No. 13/289,056, filed Nov. 4, 2011, the plow blades thereof are not quickly removably secured to the forward end of the push tube assembly.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In one embodiment, a quick-attach assembly is provided for attaching an implement to an off-road vehicle such as an ATV, UTV, lawn mower or garden tractor. The off-road vehicle includes a push tube assembly having rearward and forward ends. The rearward end of the push tube assembly is pivotally secured to the off-road vehicle with the forward end of the push tube assembly being positioned at the forward end of the vehicle. A winch cable or screw actuator is operatively connected to the push tube assembly so that the forward end thereof may be raised or lowered.

In the first embodiment, a rear female quick-attach assembly is secured to the forward end of the push tube assembly and a front male quick-attach assembly is secured to an implement such as a plow blade, rake, brush, sweeper, or the like. The rear female and front male quick-attach assemblies are adapted to be secured together to mount the implement to the off-road vehicle. In the first embodiment, the front male quick-attach assembly is positioned adjacent the lower rearward end of the plow blade.

In a second embodiment, the front male quick-attach assembly is positioned adjacent the upper rearward side of the plow blade. If the forward end of the push tube assembly dwells in a plane below the front male quick-attach assembly, a transition hitch member having a lower rearward and an upper forward end is utilized. The lower rearward end of the transition hitch member is received in and secured to the rear female quick-attach assembly and the upper forward end of the transition hitch member is secured to the front male quick-attach assembly. If the push tube assembly has an upwardly and forwardly extending portion, the transition hitch member is not used. In that case, the front male quick-attach assembly is received in and secured to the rear female quick-attach assembly.

In another embodiment, such as when the implement is a rake, sweeper, brush, etc., the front quick-attach assembly includes a rearwardly extending pivot tube, having an open rearward end, selectively pivotally mounted on the upper end of the implement. A transition hitch member has its lower rearward end detachably received by the rear quick-attach assembly and its upper forward end detachably received by the pivot tube of the front quick-attach assembly. The transition hitch member will normally extend forwardly and upwardly from the rear quick-attach assembly to the front quick-attach assembly.

It is therefore a principal object of the invention to provide a quick-attach assembly for attaching an implement to an off-road vehicle.

It is a further object of the invention to provide a quick-attach assembly for attaching an implement to an off-road vehicle wherein various types of implements may be quickly attached to the forward end of the push tube assembly of the off-road vehicle.

A further object of the invention is to provide a quick-attach assembly for an off-road vehicle which includes a rear female quick-attach assembly secured to the forward end of a push tube assembly and a front male quick-attach assembly which is attached to the rearward side of an implement with the quick-attach assemblies being designed to quickly and easily connect the rear quick-attach assembly to the front quick-attach assembly.

A further object of the invention is to provide a quick-attach assembly for an off-road vehicle which includes a rear female quick-attach assembly secured to the forward end of a push tube assembly and a front male quick-attach assembly which is pivotally attached to the upper rearward end of a plow blade with the quick assemblies designed to quickly and easily connect the rear quick-attach assembly to the front quick-attach assembly.

A further object of the invention is to provide a quick-attach assembly for an off-road vehicle which includes a rear female quick-attach assembly secured to the forward end of a push tube assembly and a front quick-attach assembly which is pivotally attached to the upper end of an implement with the quick assemblies designed to quickly and easily connect the rear quick-attach assembly to the front quick-attach assembly.

A further object of the invention is to provide a quick-attach assembly for an off-road vehicle which includes a rear female quick-attach assembly secured to the forward end of a push tube assembly and a front quick-attach assembly which is pivotally attached to the upper end of an implement with a transition hitch member extending therebetween.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
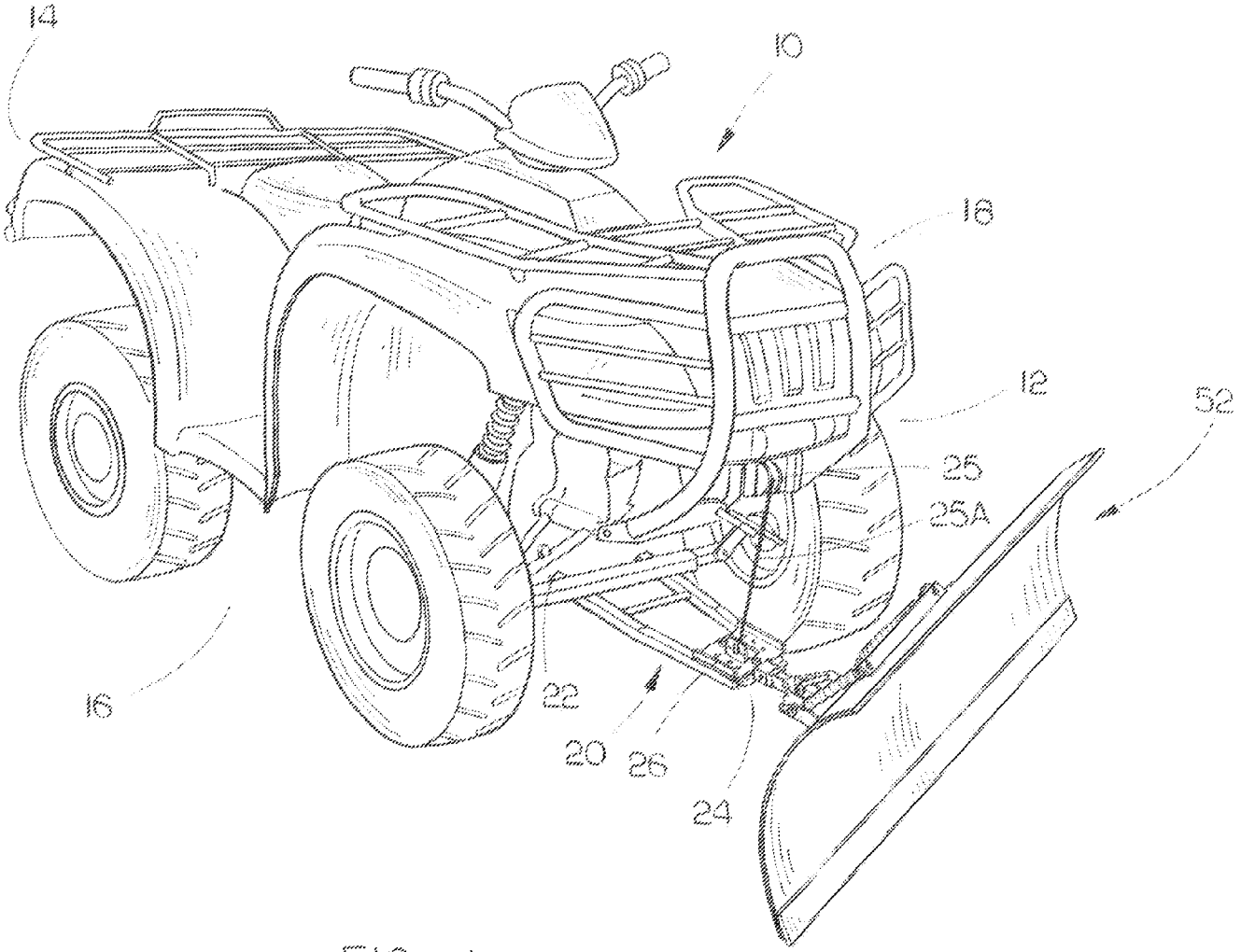
FIG. 1 is a front perspective view of an off-road vehicle having a plow blade secured thereto through the use of the quick-attach assembly of this invention.

The numeral 10 refers to an off-road vehicle such as an all-terrain vehicle (ATV), UTV, riding mower, garden tractor, etc., which may be a 2-wheel drive or a 4-wheel drive. ATV 10 includes a forward end 12, rearward end 14, right side 16, and a left side 18. The numeral 20 refers to a push-tube assembly having a rearward end 22 and a forward end 24. The rearward end 22 of the push tube assembly 20 is pivotally connected to the frame of the ATV, about a horizontal axis, in conventional fashion so that forward end 24 of the push tube assembly 20 may be raised and lowered by a winch 25, screw actuator, or other means in conventional fashion. The rearward end 22 of push tube assembly 20 could also be attached to the front suspension of the ATV 10 if so desired such as shown in FIG. 1.

In many prior art push tube assemblies, the rearward and forward ends of the push tubes thereof dwell in the generally same plane. In some cases, as in the plow blade of Bombardier, the forward ends of the push tubes dwell in a plane above the rearward ends to enable the forward end of the push tube assembly to be secured to the upper rearward end of the plow blade.

Figure 2:
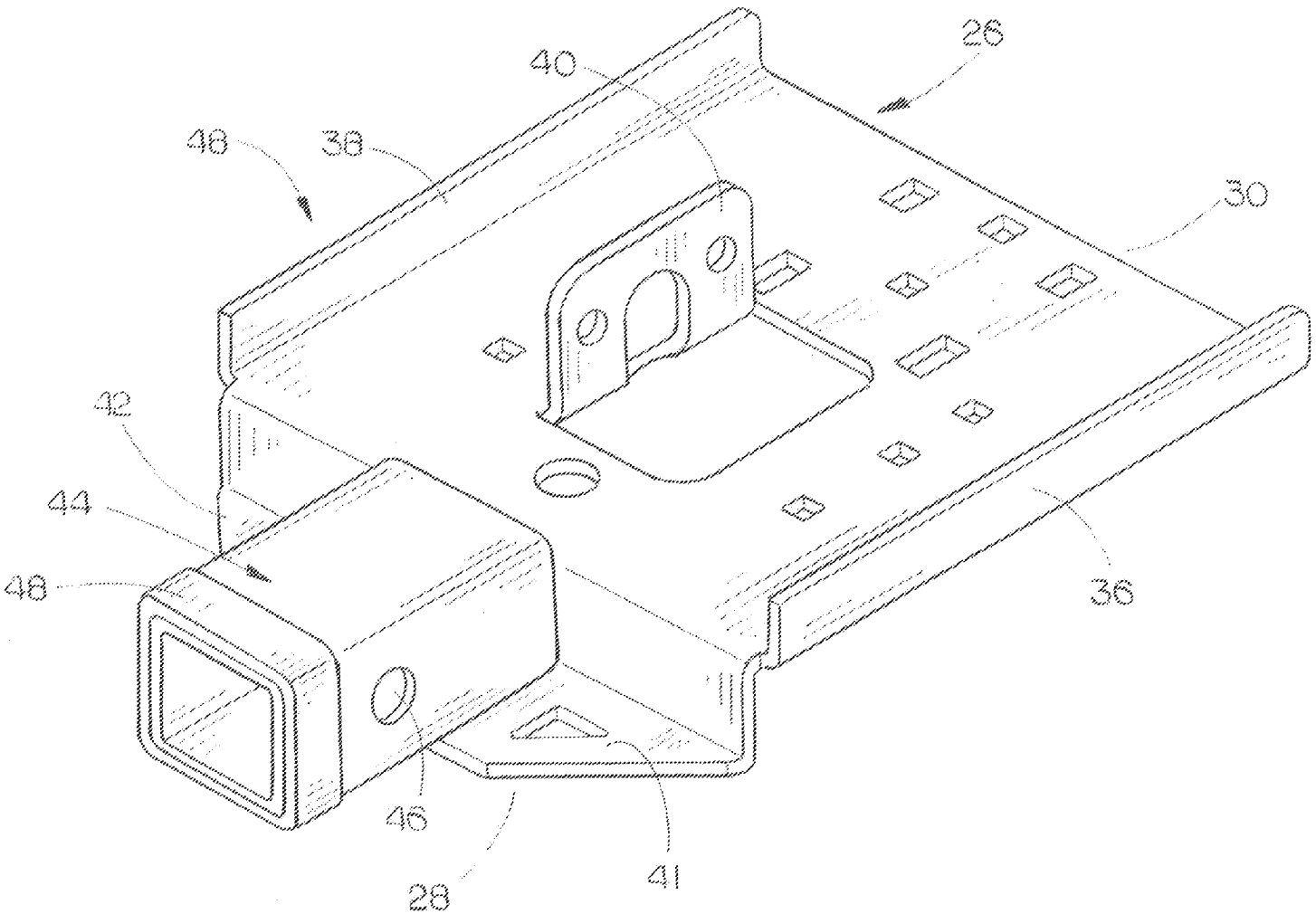
FIG. 2 is a front perspective view of the rear quick-attach, assembly.
Figure 3:
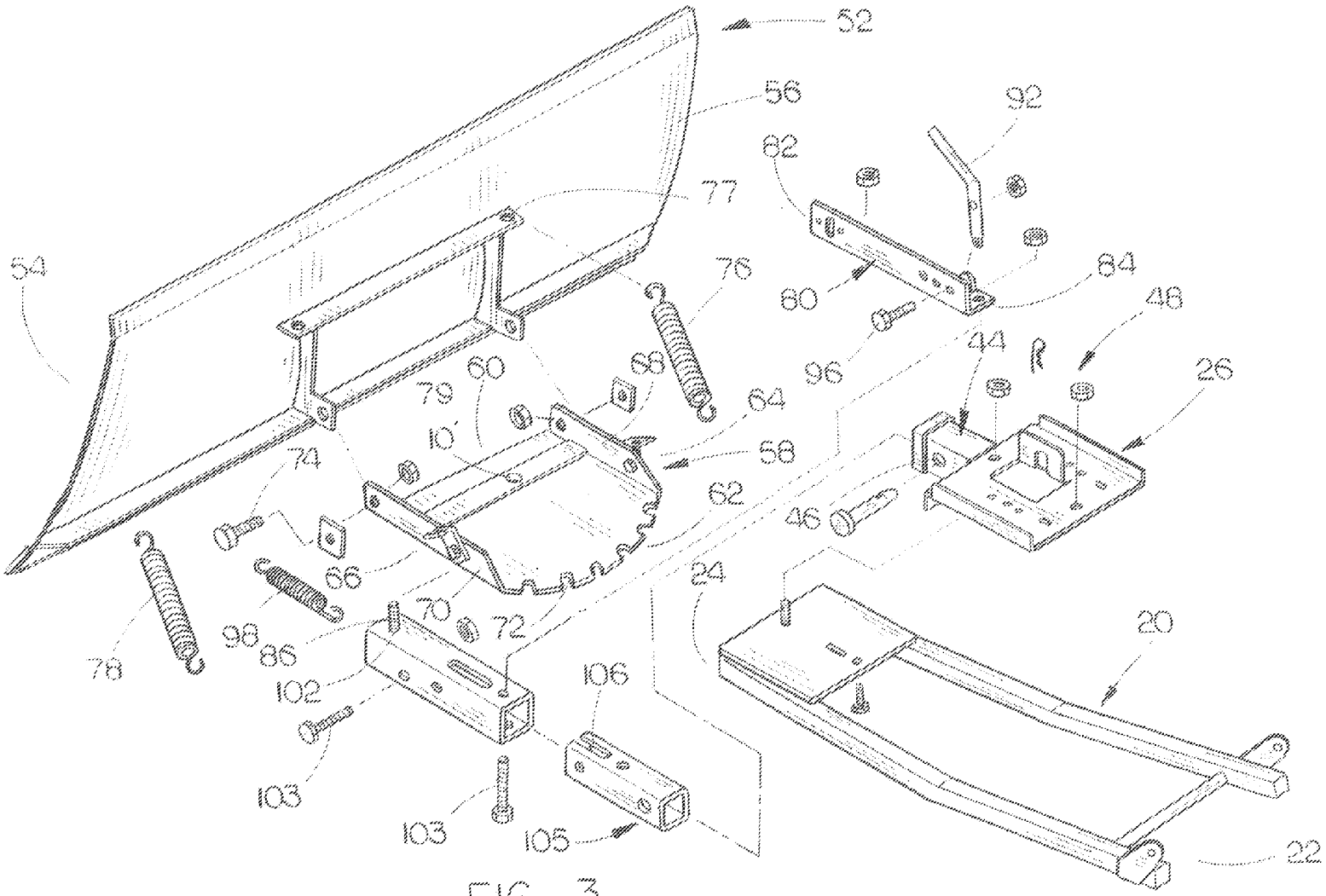
FIG. 3 is an exploded perspective view of one embodiment of the invention.
Figure 4:
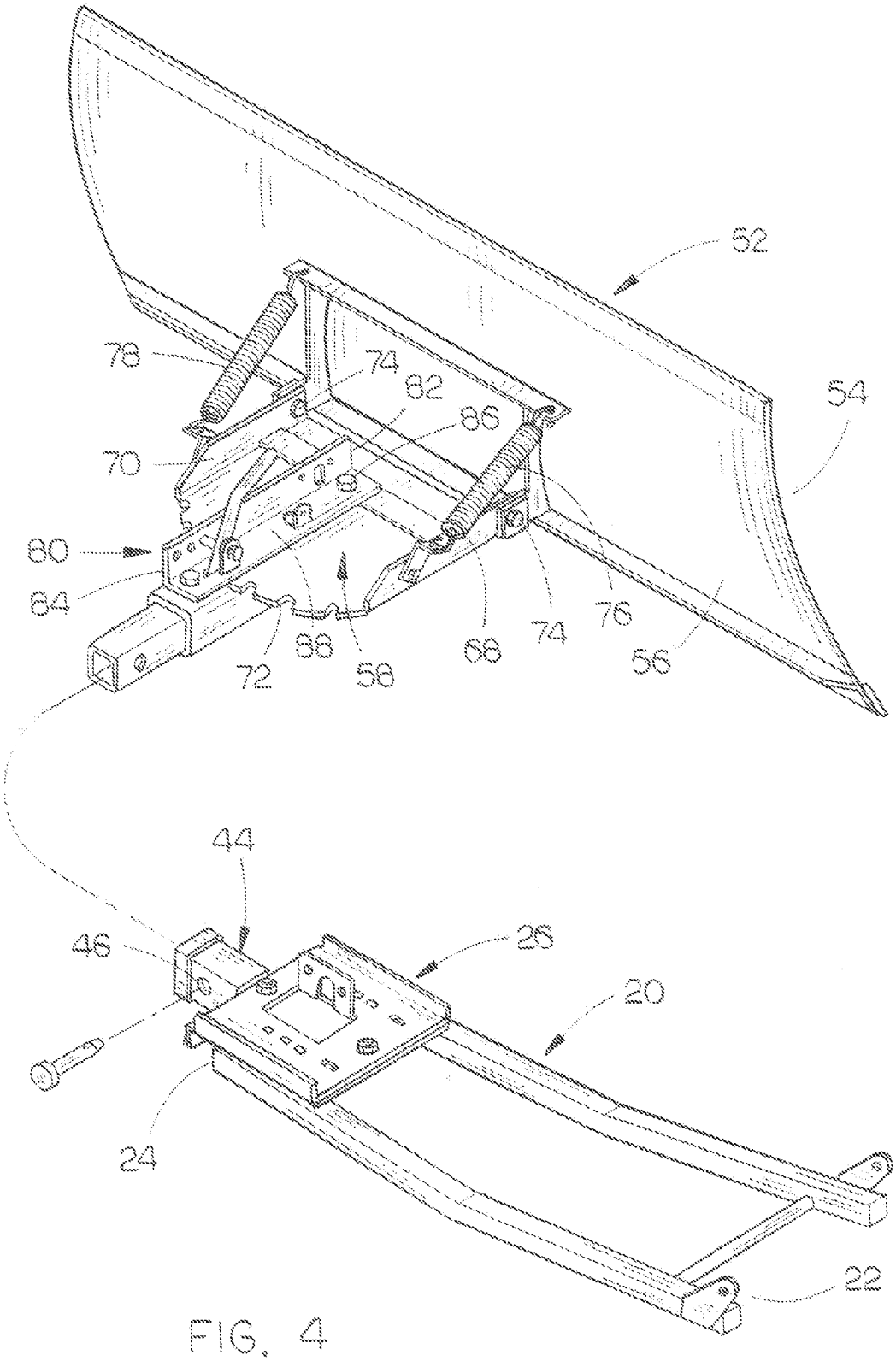
FIG. 4 is an exploded perspective view illustrating the manner in which the rear female quick-attach assembly may be attached to the front male quick-attach assembly of a plow blade.

The numeral 26 refers to a mount bracket which has a rearward end 28, a forward end 30, a right side 32 and a left side 34. The sides 32 and 34 have upstanding flanges 36 and 38 respectively for strengthening purposes. Bracket 26 includes an upstanding ear or bracket 40 which is adapted to have a winch cable 25A secured thereto. Bracket 26 has a pair of spaced-apart L-shaped supports 41 and 42 which extend forwardly therefrom as seen in FIG. 2. A square hitch receiver tube 44 has its rearward end positioned on the inner ends of supports 41 and 42 and is bolted or welded to supports 41 and 42 and bracket 26.

Tube 44 functions as a receiver or receiver tube with the side walls thereof having a pair of locking pin openings 46 formed in the side walls thereof. A strengthening ring 48 embraces the forward end of tube 44 and is welded thereto. Bracket 26 is positioned on the forward end of push tube assembly 20 and is bolted or welded thereto. Tube 44 and bracket 26 form a rear female quick-attach assembly 48.

The numeral 52 refers to an implement which is to be quickly attached to the rear female quick-attach assembly 50. The implement shown in FIGS. 1, 3, 4 and 5 is a plow blade but the implement could be a sweeper, brush, rake, bucket, etc. For purposes of description, the plow blade 52 will be described as having a forward side 54 and a rearward side 56. The numeral 58 refers to a generally horizontally disposed hinge plate having a forward end 60, a rearward end 62, a right side 64 and a left side 66. Hinge plate 58 includes right and left side walls 68 and 70 extending upwardly from the right and left sides thereof. The rearward end 62 of hinge plate 58 has a plurality of radially spaced-apart notches 72. The forward ends of side walls 68 and 70 are pivotally secured to the rearward side of blade 52 by a pair of bolts 74.

Spring 76 has its lower end secured to side wall 68 and its upper end secured to the rearward side of blade 52 at 77. A spring 78 has its lower end secured to side wall 70 and its upper end secured to the rearward side of blade 52 at 79.

An elongated lever bracket 80 is movably positioned on the upper surface of hinge plate 58 and has a forward end 82 and a rearward end 84. The forward end 82 of lever bracket 80 is pivotally secured to hinge bracket 58 by means of a vertically disposed pivot pin or bolt 86 as will be described hereinafter. The base 88 of bracket 80 has a longitudinally extending slot 90 formed therein. Locking lever 92 is pivotally secured, intermediate its length to wall portion 94 of bracket 80 by means of a pivot bolt 96 so that the lever end of lever 92 extends downwardly through slot 90 for selective engagement with one of the notches 72. Spring 98 yieldably maintains locking lever 92 in its locked position in one of the notches as will be explained in greater detail hereinafter.

An elongated tube 100 is positioned below hinge plate 58 directly below lever bracket 80. Bolt 86, extends upwardly through the forward end of tube 100, through opening 101 in hinge plate 58 and through opening 102 in lever bracket 80. Bolt 103 extends upwardly through the rearward end of tube 100 and through opening 104 in the rearward end of lever bracket 80 so that hinge plate 58 may be pivoted with respect to lever bracket 80 and tube 100.

Figure 8:
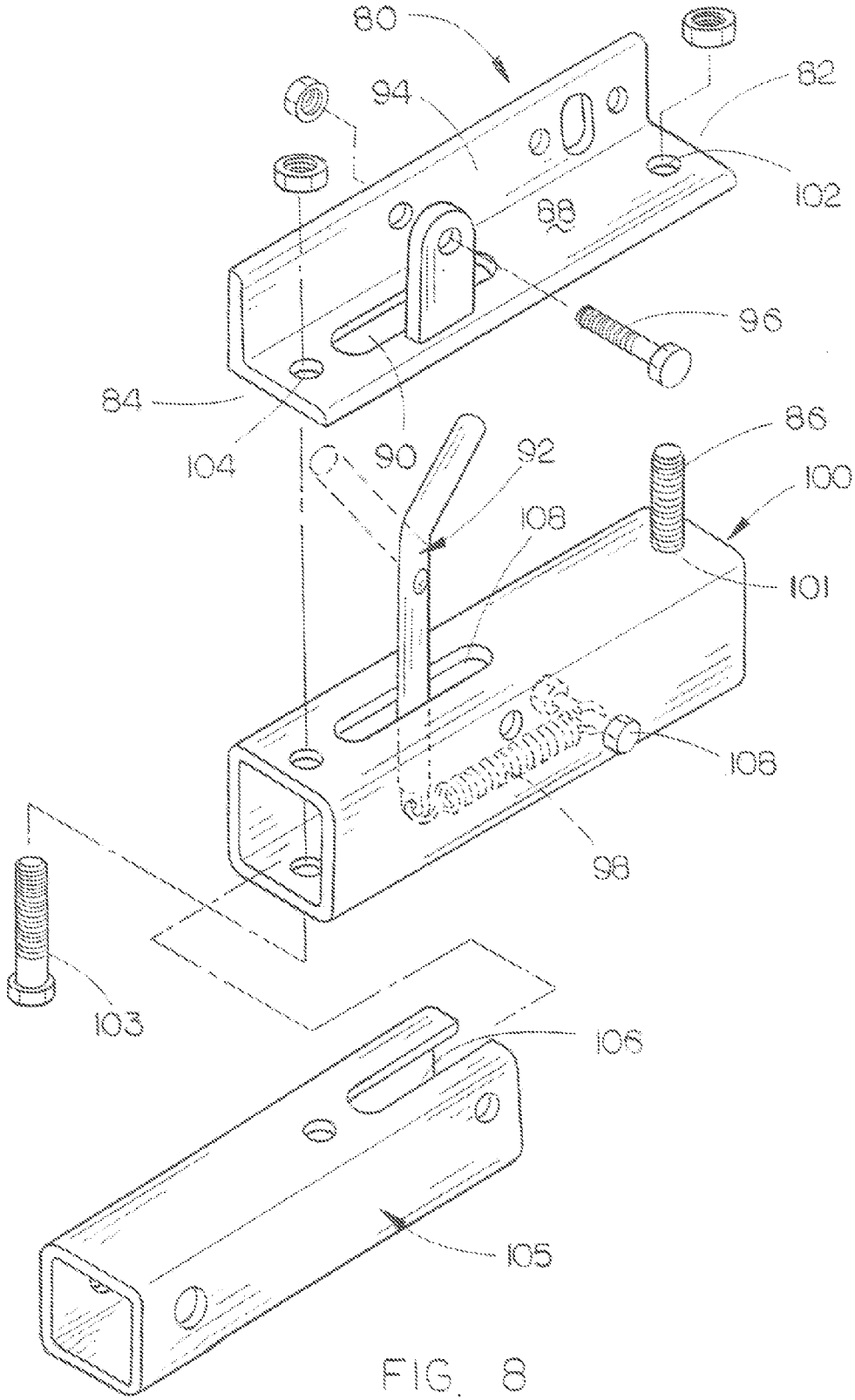
FIG. 8 is an exploded perspective view illustrating a portion of the front male quick-attach assembly which is used to secure a plow blade or the like to the rear female quick-attach assembly.

Tube 105 has its forward end received by the rearward end of tube 100 as seen in FIG. 8 and is bolted therein by bolt 107. Tube 105 has an elongated slot 106 formed in the top wall thereof which registers with the slot 108 formed in the top wall of tube 100.

As best seen in FIG. 8, the lower end of lever 92 extends downwardly through slots 108 and 106. The forward end of spring 98 is secured to tube by bolt 108 which also extends through the forward end of tube 105. Lever 92 is reversible as depicted by the broken lines in FIG. 8.

The tube 100, tube 105 and the supporting structure therefore form a front male quick-attach assembly which may be quickly attached to the rear female quick-attach assembly.

The hinge plate 58 and its associated structure is just one type of hinge plate construction. The hinge plate structure could be designed such as shown in Applicant's co-pending patent application entitled QUICK-ATTACH ASSEMBLY FOR ATTACHING AN IMPLEMENT TO AN OFF-ROAD VEHICLE, Ser. No. 13/289,056, filed Nov. 4, 2022, the disclosure of which is incorporated herewith by reference thereto to complete this disclosure if necessary. The push tube assembly described above could also have a forwardly and upwardly extending portion at its forward end so that the rear female quick-attach assembly may be attached to a front male quick-attach assembly mounted at the upper rearward side of the plow blade or other implement.

Figure 5:
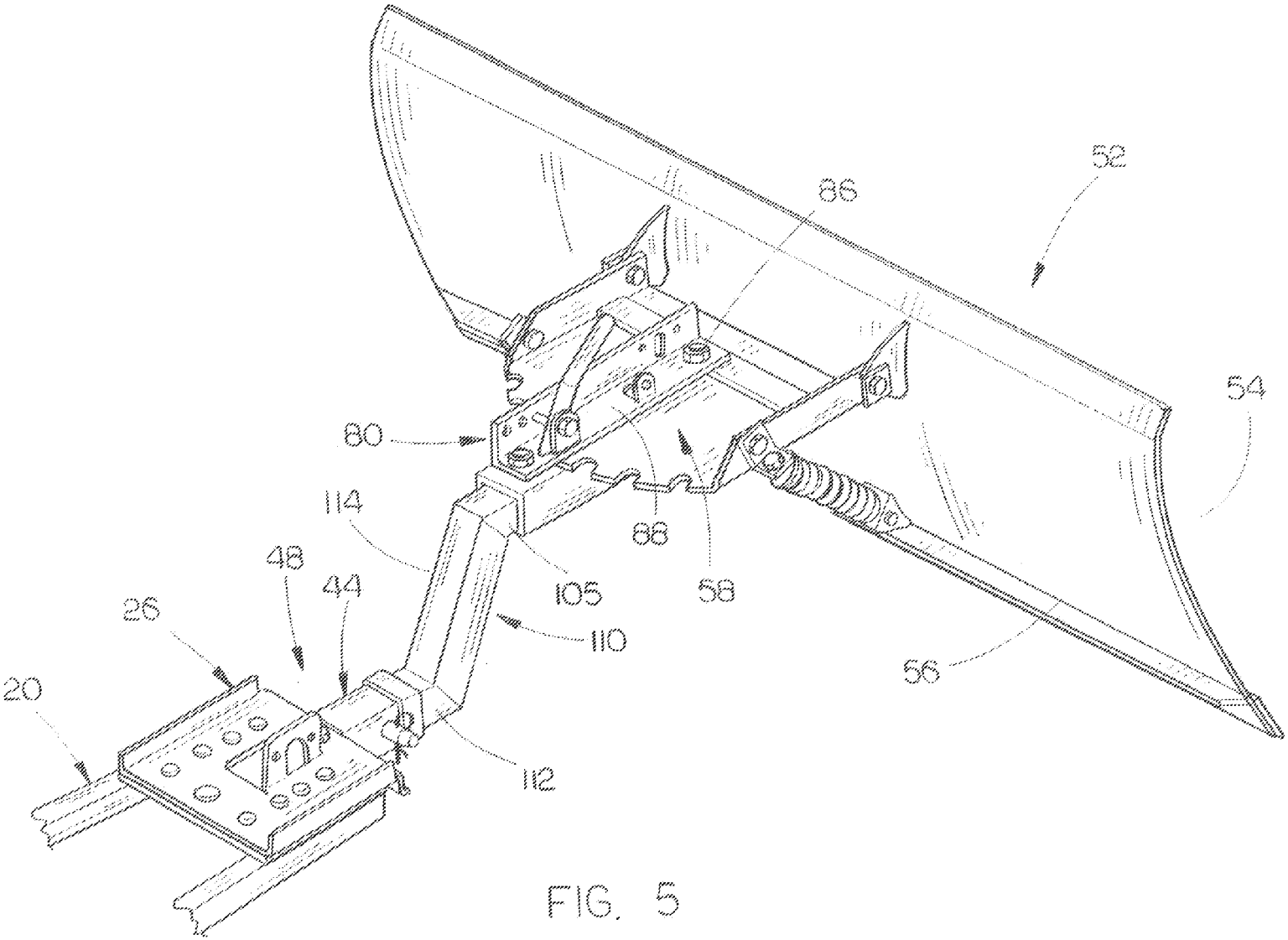
FIG. 5 is a rear perspective view illustrating the manner in which the rear female quick-attach assembly of this invention may be attached to the upper rearward end of a plow blade.

FIG. 5 illustrates a situation wherein the hinge plate 58 and associated structure are secured to the upper rearward end of the plow blade 52. In that situation, a transition hitch member 110 is utilized if the push tube assembly 20 does not have a forwardly and upwardly extending portion. Hitch member 110 includes a rearward end 112 which is received by and secured to tube 44. Hitch member 110 also includes an intermediate section 114 which extends upwardly and forwardly from end 112. The upper end of section 114 is secured to the rearward end of tube 105 by welding or the like. Tube 105 is received by tube 100 as previously described. If the push tube assembly 20 does not have an upper forward portion, tube 105 will be received by and secured to tube 44.

Figure 7:
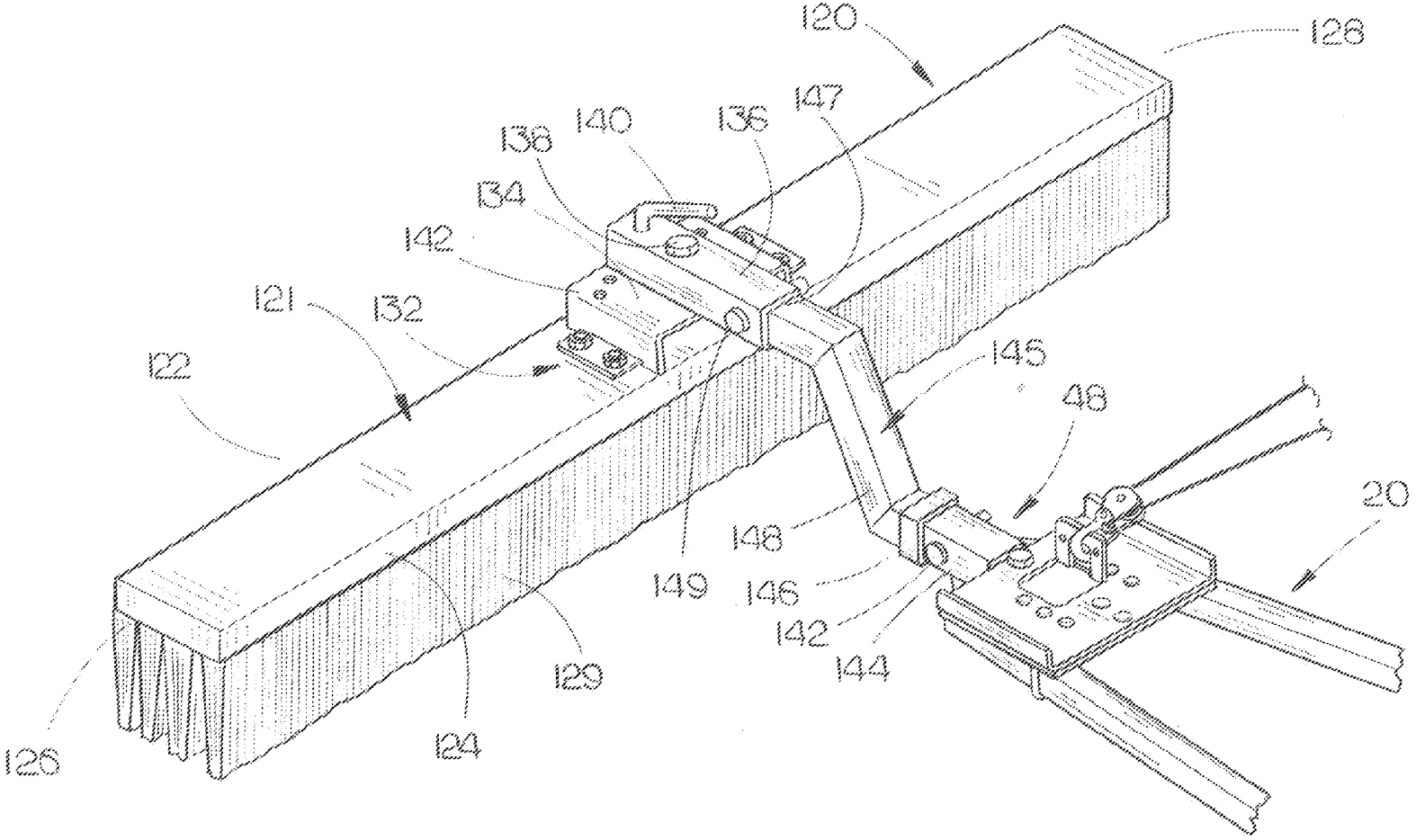
FIG. 7 is a rear perspective view illustrating the manner in which the rear female quick-attach assembly may be attached to a brush.

In FIG. 7, the numeral 120 refers to an implement such as a brush which was originally designed to be pulled by an ATV or the like. With the Applicant's rear female quick-attach assembly 48, the brush 120 may be mounted at the forward end of the AN. For purposes of description, brush 120 will be described as having a main frame 121, forward end 122, rearward end 124, a left end 126, and a right end 128. Brushes 130 are secured to main frame 121 and extend downwardly therefrom. Bracket 132 is bolted to main frame 121 and includes an upper plate 134. An elongated pivot tube 136 is pivotally secured to plate 134, about a vertical axis, by pin or bolt 138. A bent hitch pin 140 selectively removably extends downwardly through pivot tube 136 with the lower end of hitch pin 140 being received by one of a plurality of radially spaced-apart openings 142 formed in plate 134 to lock pivot tube 136 in various angular positions with respect to plate 134. The rearward end of pivot tube 136 is open and has a pair of registering openings formed in the side walls thereof adapted to receive a locking pin or bolt 144 therein.

The numeral 145 refers to a transition hitch member having a rearward end 146, a forward end 147, and an intermediate hitch portion 148 extending therebetween which extends upwardly and forwardly from end 146 to end 147. The rearward end 146 of hitch member 145 is received by tube 44 and secured thereto by bolt. The forward end 147 of hitch member 145 is received by the open rearward end of pivot tube 136 and secured thereto by bolt 149.

Figure 6:
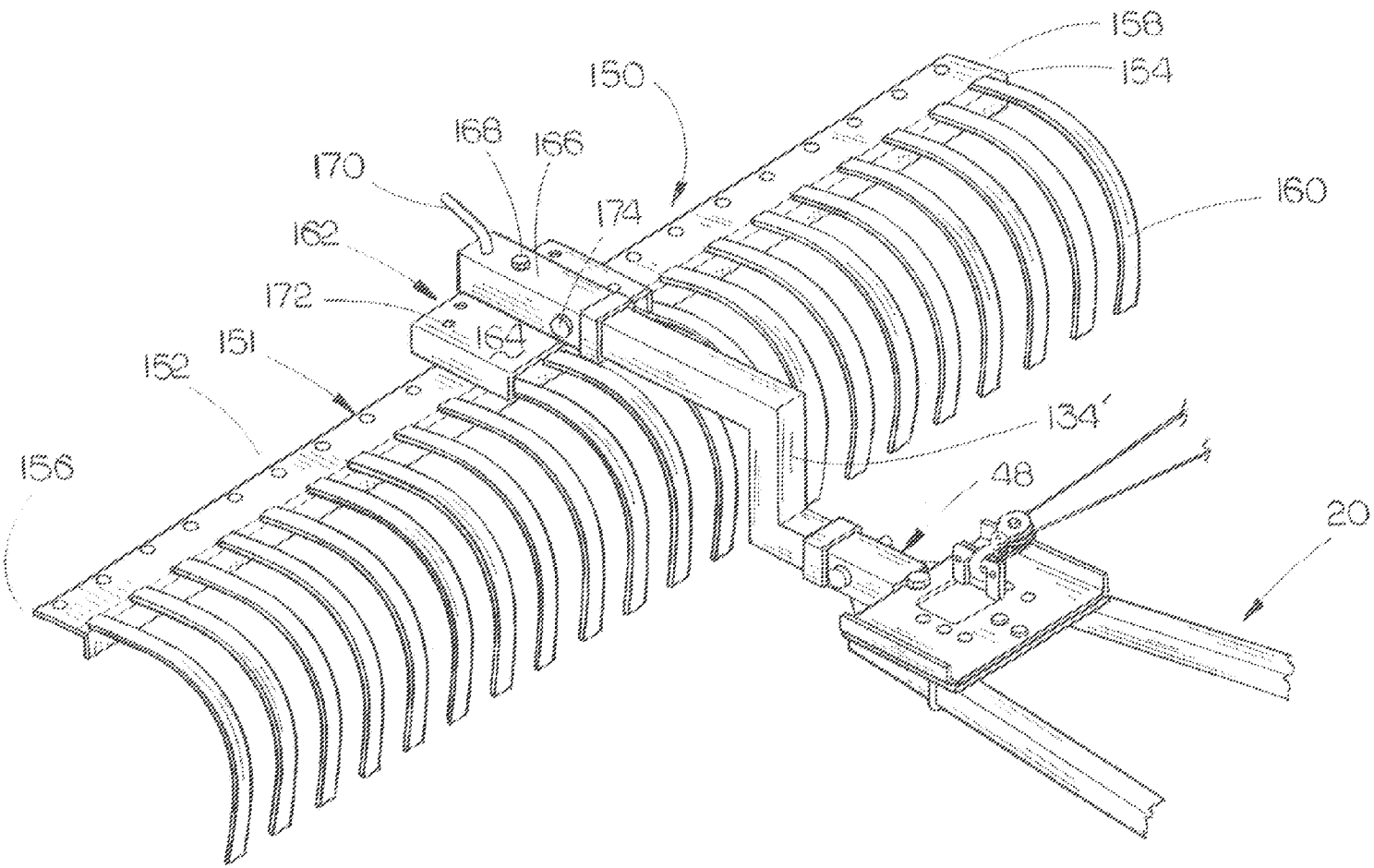
FIG. 6 is a rear perspective view illustrating the manner in which the rear female quick-attach assembly of this invention may be attached to a rake.

In FIG. 6, the numeral 150 refers to an implement such as a rake which was originally designed to be pulled by an ATV or the like. With Applicant's rear female quick-attach assembly 48, the rake 150 may be mounted at the forward end of the ATV. For purposes of description, rake 150 will be described as having main frame 151 with a forward end 152, rearward end 154, a left end 156, and a right end 158. Tines 160 are secured to main frame 151 and extend downwardly therefrom. Bracket 162 is bolted or otherwise secured to main frame 151 and includes an upper plate 164. An elongated pivot tube 166 is pivotally secured to plate 164, about a vertical axis, by a pin or bolt 168. A bent hitch pin 170 selectively removably extends downwardly through pivot tube 166 with the lower end of hitch pin 170 being received by one of a plurality of radially spaced-apart openings 172 formed in plate 164 to lock pivot tube 166 in various angular positions with respect to plate 164. The rearward end of pivot tube 166 is open and has a pair of registering openings formed in the side wall thereof adapted to receive a locking pin or bolt 174 therein.

A transition hitch member 134', or one similar thereto, may be used as described above to quickly attach and interconnect the female quick-attach assembly 48 to the pivot tube 166.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

an off-road vehicle having forward and rearward ends;

a push tube assembly having forward and rearward ends;

said rearward end of said push tube assembly being secured to said off-road vehicle so that said forward end of said push tube assembly is positioned at said forward end of said vehicle;

a plow blade having a forward side, a rearward side, an upper end and a lower end;

a mounting bracket secured to said forward end of said push tube assembly;

a receiver tube, having an open forward end, secured to said mounting bracket which extends forwardly therefrom;

a hinge plate having forward and rearward ends and upper and lowers sides;

said forward end of said hinge plate being pivotally secured, about a horizontal axis, to said rearward side of said plow blade;

said rearward end of said hinge plate having a plurality of horizontally spaced-apart notches formed therein;

an elongated lever bracket having forward and rearward ends;

said lever bracket being movably positioned above said upper side of said hinge plate so that said rearward end of said lever bracket is positioned rearwardly of said rearward end of said hinge plate;

a pivot pin pivotally securing said forward end of said lever bracket to said hinge plate about a vertical axis;

a rearwardly extending first tube having a rearward end and a forward end;

said first tube being positioned below said lower side of said hinge plate directly below said lever bracket so as to be parallel to said lever bracket with said rearward end of said first tube being positioned rearwardly of said rearward end of said hinge plate;

said pivot pin also pivotally securing said forward end of said first tube to said hinge plate;

said rearward end of said lever bracket being secured to said first tube rearwardly of said rearward end of said hinge plate;

a locking lever pivotally secured to said lever bracket which is selectively pivotally movable between locked and unlocked positions;

said locking lever when in said locked positioned engaging one of said notches in said rearward end of said hinge plate to lock said plow blade in a selected angular plowing position;

said locking lever, when in said unlocked position, permitting said plow blade to be angularly moved to a selected angular plowing position; and a second tube, having rearward and forward ends;

said plow blade being selectively attached to said push tube assembly of said vehicle by positioning said forward end of said second tube into said rearward end of said first tube and securing said second tube to said first tube and positioning said rearward end of said second tube into said open forward end of said receiver tube and securing said second tube to said receiver tube.

2. The combination of claim 1 wherein a spring is positioned in said first tube which is connected to said locking lever to yieldably maintain said locking lever in said locked position.

3. The combination of claim 1 wherein said hinge plate is secured to said plow blade at said lower rearward end thereof.

4. The combination of claim 1 wherein said hinge plate is secured to said plow blade at said upper rearward end thereof.

5. The combination of claim 4 wherein said second tube is a transition hitch member interconnecting said first tube and said receiver tube.

6. In combination:

an off-road vehicle having forward and rearward ends;

a push tube assembly having forward and rearward ends;

said rearward end of said push tube assembly being secured to said off-road vehicle so that said forward end of said push tube assembly is positioned at said forward end of said vehicle;

an implement having a forward side, a rearward side, an upper end and a lower end;

a mounting bracket secured to said forward end of said push tube assembly;

a receiver tube, having an open forward end, secured to said mounting bracket which extends forwardly therefrom;

a hinge plate having forward and rearward ends and upper and lowers sides;

said forward end of said hinge plate being pivotally secured, about a horizontal axis, to said rearward side of said implement;

said rearward end of said hinge plate having a plurality of horizontally spaced-apart notches formed therein;

an elongated lever bracket having forward and rearward ends;

said lever bracket being movably positioned above said upper side of said hinge plate so that said rearward end of said lever bracket is positioned rearwardly of said rearward end of said hinge plate;

a pivot pin pivotally securing said forward end of said lever bracket to said hinge plate about a vertical axis;

a rearwardly extending first tube having a rearward end and a forward end;

said first tube being positioned below said lower side of said hinge plate directly below said lever bracket so as to be parallel to said lever bracket with said rearward end of said first tube being positioned rearwardly of said rearward end of said hinge plate;

said pivot pin also pivotally securing said forward end of said first tube to said hinge plate;

said rearward end of said lever bracket being secured to said first tube rearwardly of said rearward end of said hinge plate;

a locking lever pivotally secured to said lever bracket which is selectively pivotally movable between locked and unlocked positions;

said locking lever when in said locked positioned engaging one of said notches in said rearward end of said hinge plate to lock said implement in a selected angular position;

said locking lever, when in said unlocked position, permitting said implement to be angularly moved to a selected angular position; and a second tube, having rearward and forward ends;

said implement being selectively attached to said push tube assembly of said vehicle by positioning said forward end of said second tube into said rearward end of said first tube, and securing said second tube to said first tube, and positioning said rearward end of said second tube into said open forward end of said receiver tube, and securing said second tube to said receiver tube.

7. The combination of claim 6 wherein a spring is positioned in said first tube which is connected to said locking lever to yieldably maintain said locking lever in said locked position.

8. The combination of claim 6 wherein said hinge plate is secured to said implement at said lower rearward end thereof.

9. The combination of claim 6 wherein said hinge plate is secured to said implement at said upper rearward end thereof.

10. The combination of claim 9 wherein said second tube is a transition hitch member interconnecting said first tube and said receiver tube.

* * * * *